US005167191A

United States Patent [19]

Muth

[11] Patent Number: 5,167,191

[45] Date of Patent: Dec. 1, 1992

[54] GUSSETED MOBILE STORAGE SYSTEM

[75] Inventor: James C. Muth, Eagle, Wis.

[73] Assignee: Spacesaver Corporation, Fort Atkinson, Wis.

[21] Appl. No.: 496,321

[22] Filed: Mar. 20, 1990

[51] Int. Cl.[5] ..... A47B 9/00

[52] U.S. Cl. ..... 108/108; 108/107; 211/208; 211/189

[58] Field of Search ..... 108/107, 108, 109, 110, 108/111; 312/128, 132; 211/182, 189, 207, 208, 175, 151, 135

[56] References Cited

U.S. PATENT DOCUMENTS

| | | | |
|---|---|---|---|
| 1,165,566 | 12/1915 | Borden | 108/108 |
| 3,801,176 | 4/1974 | Higbee | 312/201 |
| 4,093,078 | 6/1978 | Radek | 211/182 |

*Primary Examiner*—Kenneth J. Dorner
*Assistant Examiner*—Gerald Anderson
*Attorney, Agent, or Firm*—Fuller, Ryan, Hohenfeldt & Kees

[57] ABSTRACT

An upright shelf unit with cantilevered shelves for mounting to the carriage of a mobile storage system. The shelf unit is assembled from a pair of end uprights mounted to the carriage and spaced apart from each other, and at least one interior upright mounted to the carriage between the end uprights, to form pairs of adjacent uprights. Each of the uprights has slots formed therein to accommodate a plurality of shelves. Each shelf has hooks at each end for engaging with the slots of an upright at each end. The interior upright is constructed of a pair of channels facing together. Welded between the two channels is a trapezoidal gusset and above that a rectangular reinforcing member, both having the same thickness. The top end of the gusset and the bottom end of the reinforcing member butt together about halfway up the upright. The width of the reinforcing member and the top end of the gusset are approximately the width of the channels, the thickness being the same. The width of the gusset increases gradually toward the bottom end of the gusset until it is substantially wider than the channels. Together, in the butting relationship just described, the gusset and reinforcing member extend over the entire length of the channels.

4 Claims, 3 Drawing Sheets 38
40

34
48

34
46
9
9
8
8
7
7
46
46
46
46
48
34
34
36
32
44

36
40
44
42

GUSSETED MOBILE STORAGE SYSTEM

BACKGROUND OF THE INVENTION

This invention relates to mobile storage systems, and in particular to such mobile storage systems having cantilevered shelves.

Mobile storage systems comprise a series of storage units which have shelves or bins, for example. Each of the storage units is movable on rails to create an access aisle between two of the units and to establish the others in close side-by-side relationship, to minimize the amount of floor space required for the units.

Cantilevered shelving units offer advantages over conventional side-supported shelving units in the areas of flexibility and in the overall ability to accommodate varying sized loads. Up to the present, however, in certain applications, cantilevered shelving units in general lacked the structural integrity to be suitable for use with mobile storage systems, at least with very heavy loads. Certain cantilevered shelving units have been sold as "welded" shelving units, but they have been generally units where the corners have been welded together, rather than having reinforcements welded in.

This invention relates to improvements to the structures described above and to solutions to some of the problems raised or not solved thereby.

SUMMARY OF THE INVENTION

The invention relates to an upright shelf unit with cantilevered shelves for mounting to the carriage of a mobile storage system. The shelf unit is assembled from a pair of end uprights mounted rigidly to the carriage and substantially parallel to each other, and spaced apart from each other, and at least one interior upright mounted rigidly to the carriage between and substantially parallel to the end uprights, to form pairs of adjacent uprights. Each of the uprights has slots formed therein to accommodate a plurality of shelves. Each shelf has hooks at each end for engaging with the slots of an upright at each end. The shelves being cantilevered, they project outward from the uprights. The interior upright is constructed of a pair of channels facing together. Welded between the two channels is a trapezoidal gusset and above that a rectangular reinforcing member. The top end of the gusset and the bottom end of the reinforcing member butt together about halfway up the upright. The width of the reinforcing member and the top end of the gusset are approximately the width of the channels. The bottom end of the gusset is substantially wider than the channels. Together, in the butting relationship just described, the gusset and reinforcing member extend the entire length of the channels.

Other objects and advantages of the invention will become apparent hereinafter.

DESCRIPTION OF THE DRAWING

FIG. 9 is a cross-sectional view of the frame shown in FIG. 5, taken generally along line 9—9.

DESCRIPTION OF THE PREFERRED EMBODIMENT

Figure 2:
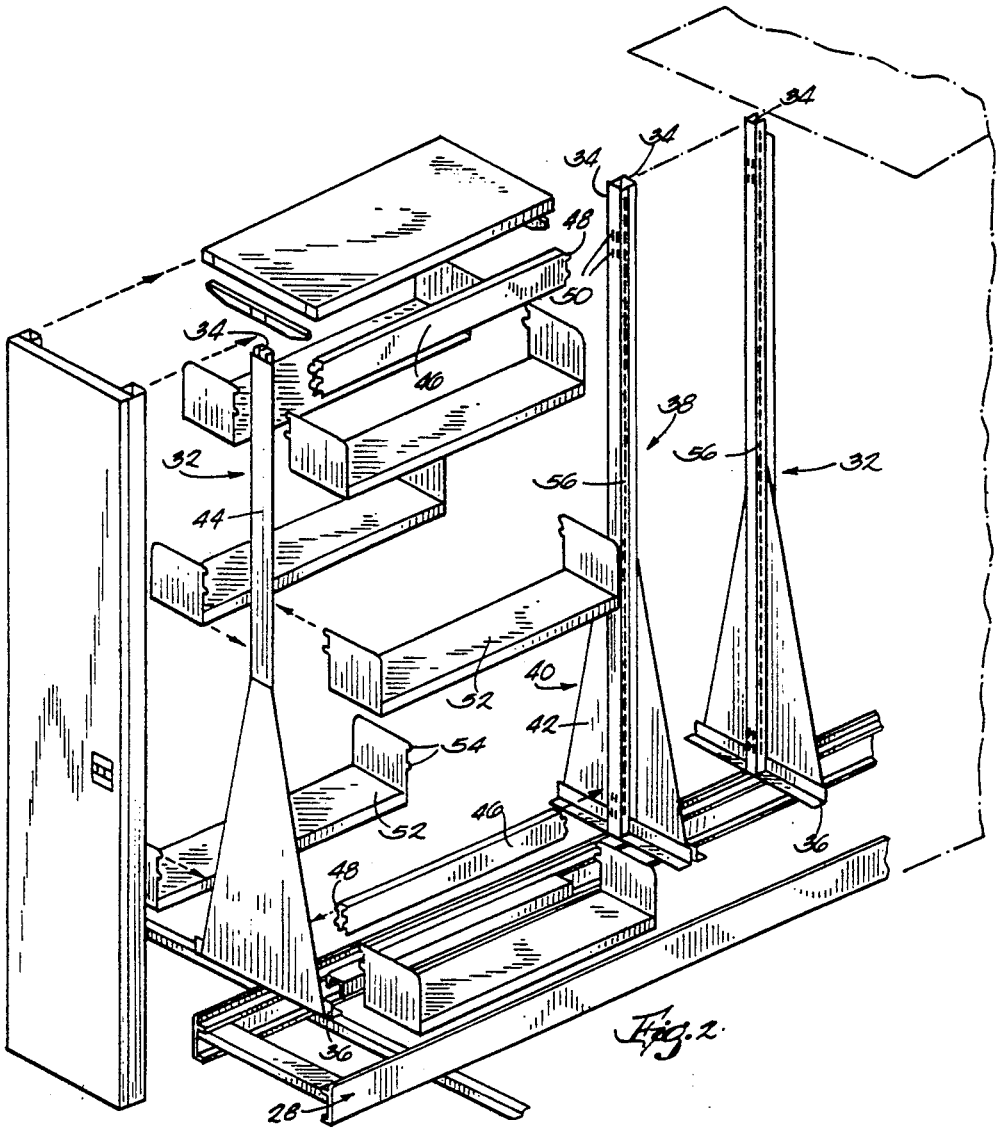
FIG. 2 is an exploded isometric view of a single storage unit constructed as shown in FIG. 1.
Figure 1:
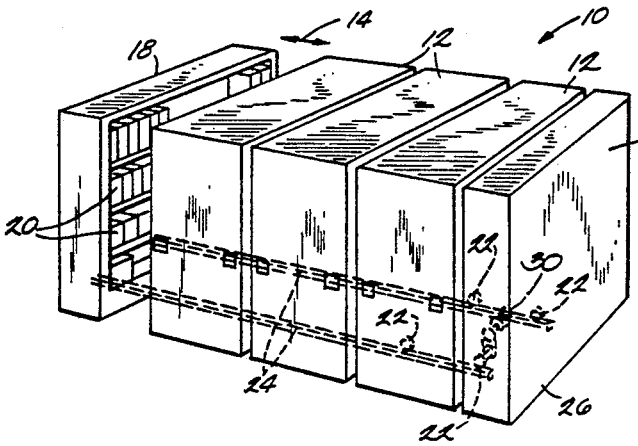
FIG. 1 is an isometric view of a mobile storage system constructed according to a preferred embodiment of the invention.

Referring now to FIG. 1, there is shown a storage system 10 including several mobile storage units 12 arranged to move alternately and selectively to the left and right as depicted at 14 to establish an access aisle between them as needed by a user. In some installations there may be a dozen or more of such units 12. The mobile storage units 12 usually are moved between a pair of stationary end storage units 16 and 18. As is well known, the storage units are commonly used to store various different items 20, such as hardware, books and files for example. As is also well known, each mobile storage unit 12 normally has four wheels 22 which run on tracks 24. These tracks 24 are often recessed in slots in a floor of the room in which the storage units are installed, or a modular floor may be built up above the existing floor 26 so as to recess the tracks. As can be seen in FIG. 1, these storage units 12 are generally high and narrow in the direction of movement 14. Without provision to the contrary, a unit 12 either beginning its movement to open an aisle or ending its movement to close an aisle could be subject to substantial inertial forces, which under certain circumstances could exceed the strength of the uprights of a cantilevered shelving system. The present invention is directed to the reinforcement of a cantilevered shelving system to avoid such an occurrence.

According to the invention, each mobile storage unit 12 has a carriage frame 28 (shown best in FIG. 2), having generally four wheels 22 (FIG. 1) journaled thereto as referred to above, at least one of which is a driven wheel, driven by any suitable prime mover 30 (FIG. 1). Referring now to FIGS. 2 through 9, each unit 12 is constructed in part of a frame 31 (FIG. 5) comprising a number of uprights of different types. At each end of a storage unit 12 will be an end upright 32. Each end upright 32 is constructed in part of a single channel 34, having connected orthogonally at its bottom a support angle 36. The length of the support angle 36 is preferably about one-fourth of the length of the channel 34. The upright 32 is affixed to the carriage frame 28 by any suitable means such as bolting the support angle 36 thereto.

Figure 4:
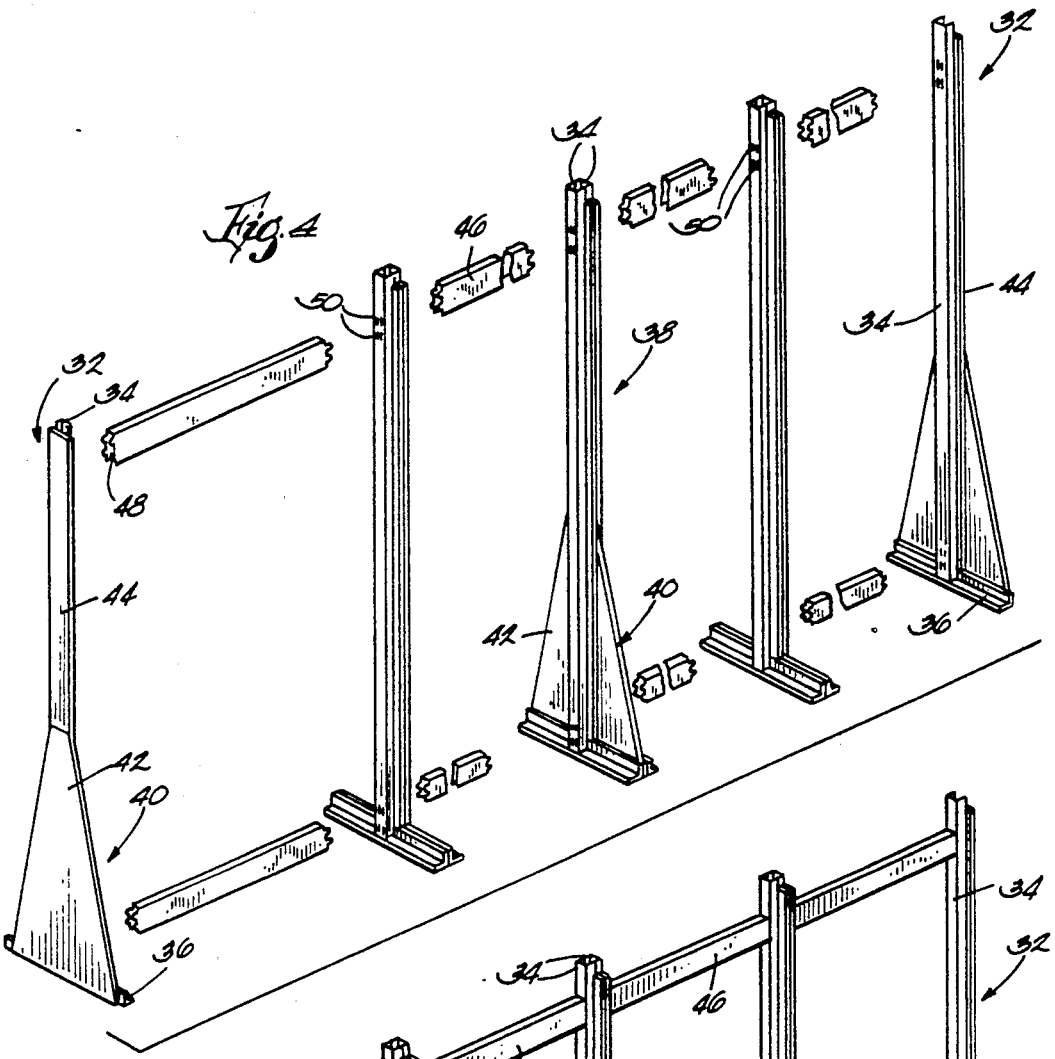
FIG. 4 is an exploded isometric view of the assembled frame shown in FIG. 3.
Figure 3:
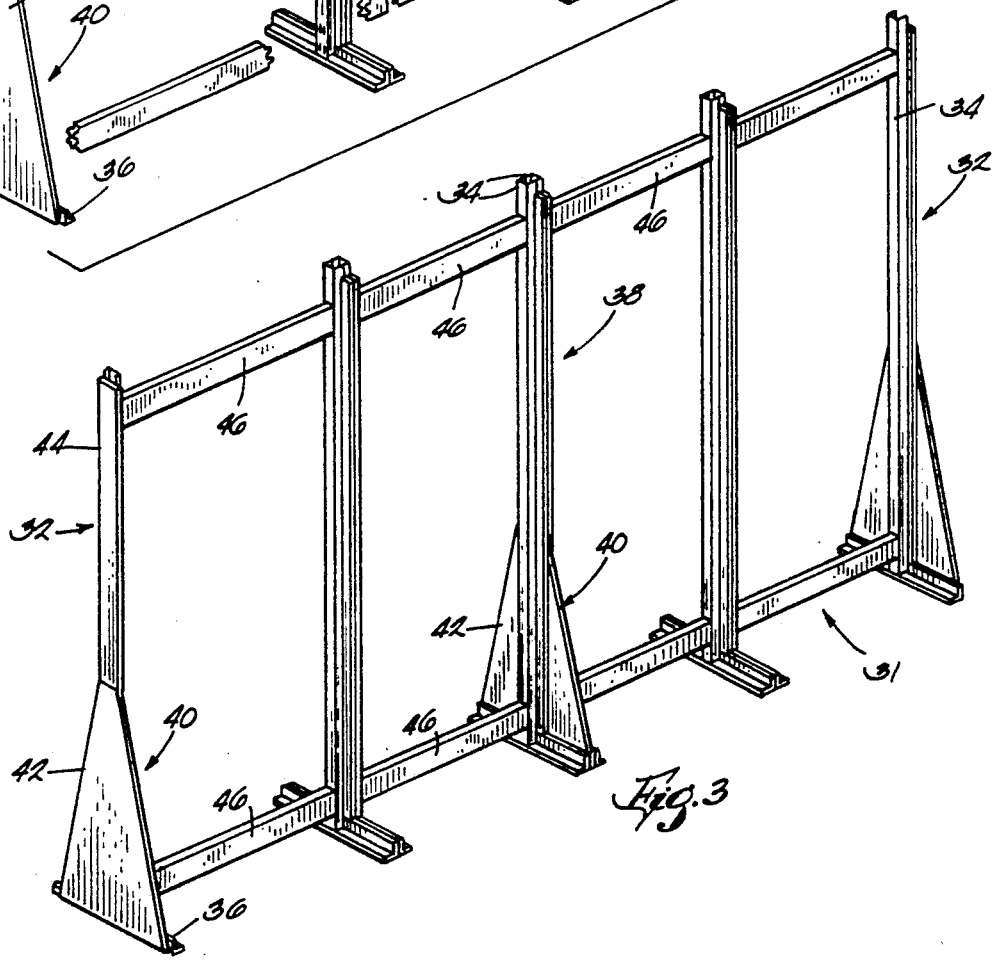
FIG. 3 is an isometric view of an assembled frame constructed according to a preferred embodiment of the invention.
Figures 2, 5, 6, 7, 8:
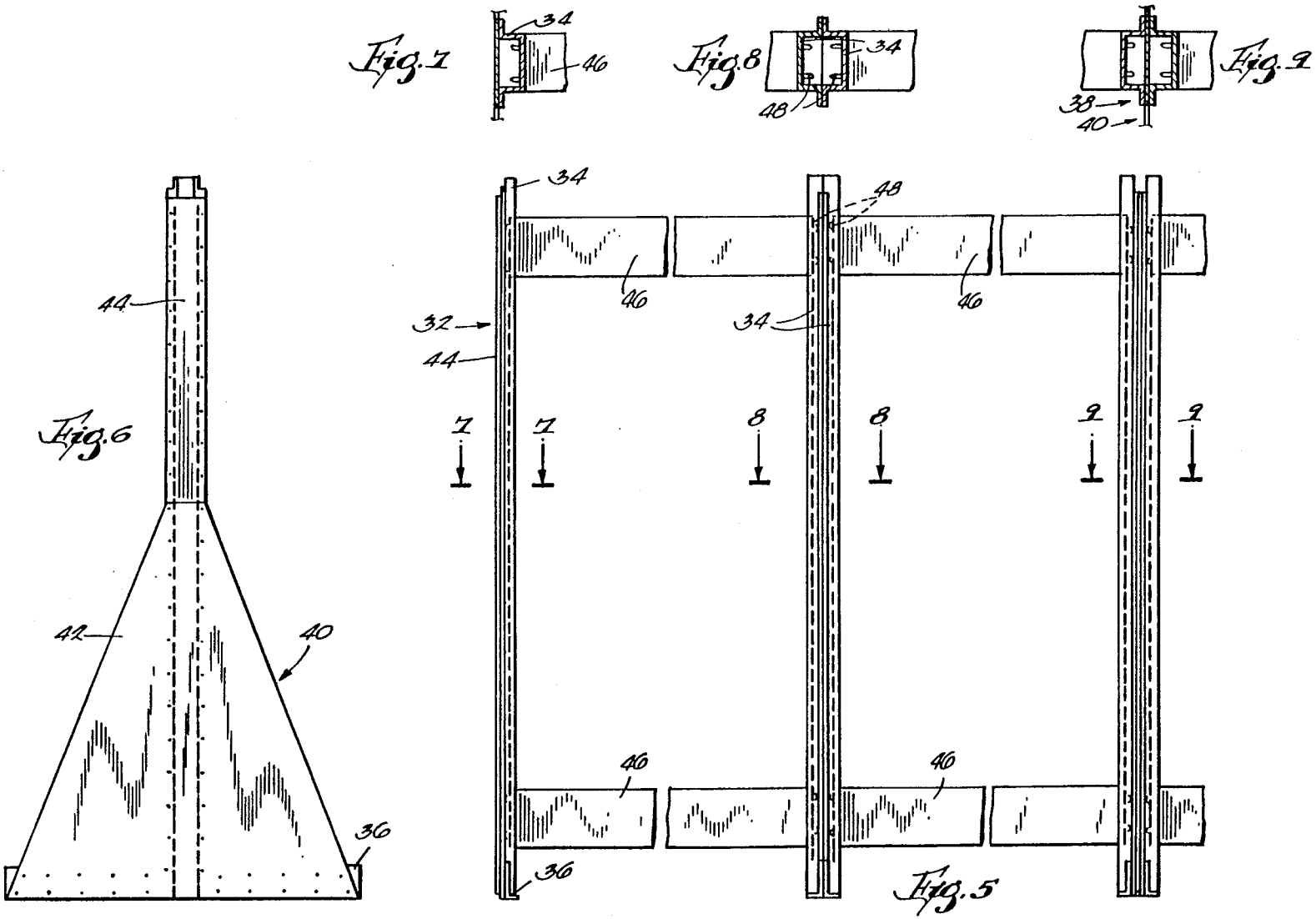
FIG. 5 is a front elevational view of the assembled frame shown in FIG. 3.
FIG. 6 is an end elevational view of the assembled frame shown in FIG. 3.
FIG. 7 is a cross-sectional view of the frame shown in FIG. 5, taken generally along line 7—7.
FIG. 8 is a cross-sectional view of the frame shown in FIG. 5, taken generally along line 8—8.

Each frame 31 also includes at least one interior upright 38. Each such upright 38 is constructed of two channels 34, facing each other. Each end upright 32 also includes gusseting means 40 for reinforcing and strengthening the upright. In addition, at least some of the interior uprights 38 will also include gusseting means 40, for the same reasons. In one embodiment, as shown in FIGS. 3, 4 and 5, depending upon how many interior uprights 38 are required to attain the desired shelf length, there may be gusseted and non-gusseted uprights alternating along the length of the frame 31.

To provide maximum strength, the gusseting means 40 for both end uprights 32 and interior uprights 38 must extend the entire length of the channel or channels 34, and must be welded to the channels along its entire length, at least by spot welding, or by fill welding in openings formed for that purpose in the channels. That is, for end upright 32, the gusseting means 40 is welded to the channel 34 along its entire length, with the channel oriented so that the legs of the channel contact the gusseting means. Similarly, for the interior gusseted upright 38, the gusseting means 40 is welded between the two channels 34, which are oriented so that the legs of the channels point toward each other, both contacting the gusseting means and being welded thereto.

In the embodiment shown in the drawing figures, the gusseting means 40 includes a gusset 42 and a reinforcing member 44. The gusset 42 has a trapezoidal shape. The length of the gusset 42 is such that its top end is positioned about halfway up the upright 32, 38, the width of the top end of the trapezoid being approximately the width of the channel 34, possibly slightly wider. The bottom end of the trapezoid, of course, is substantially wider than the channel so as to provide the reinforcing referred to above, and is positioned about even with the bottom end of the channel 34. As shown best in FIG. 6, the reinforcing member 44 has a substantially rectangular shape, of a uniform width about the same as the width of the top end of the gusset 42, and the same thickness as the gusset. The reinforcing member 44 extends from butting relationship with the top end of the gusset 42 to about the top end of the upright 32, 38. One of the functions of the reinforcing member 44 is to ensure that when the two channels 34 are placed together with the gusset 42 between and welded in that position, there is no crushing or bending of the channels upon assembly, as such crushing or bending would reduce the overall strength of the frame 31.

Once assembled by welding as indicated above, including the gusset 42, the reinforcing member 44, the support angle 36 and the one or two channels 34, depending upon whether the upright is an interior upright 38 or and end upright 32, the uprights provide an easily shipped yet very strong frame member for the assembly of units 12. As indicated above, in assembly, the support angle 36 is bolted or otherwise attached to the carriage frame 28, at predetermined intervals. Then, spreader bars 46 are removably attached between adjacent pairs of uprights 32, 38, by known means such as hooks 48 placed into slots 50 previously prepared in the channels 34 for that purpose. The spreader bars are oriented generally longitudinally with respect to the carriage frame 28. Finally, the shelves 52 themselves are connected to the uprights 32, 38 in generally the same manner, that is, by hooks 54 fitting into slots 56 formed in the side faces of the channels 34 for that purpose. The result is a mobile storage unit with exceptional strength with respect to the cost and ease of shipping of the parts.

While the apparatus hereinbefore described is effectively adapted to fulfill the aforesaid objects, it is to be understood that the invention is not intended to be limited to the specific preferred embodiments of gusseted mobile storage system set forth above. Rather, it is to be taken as including all reasonable equivalents within the scope of the following claims.

I claim:

1. An upright shelf unit for mounting to the carriage of a mobile storage system, said shelf unit comprising:

a pair of end uprights mounted rigidly to said carriage and substantially parallel to each other, and spaced apart from each other;

one or more interior uprights mounted rigidly to said carriage between and substantially parallel to said end uprights;

said interior uprights comprising:

a pair of beams of channel cross-section, oriented vertically and with the flanges of said beams extending toward each other;

gusseting means which run the entire vertical length thereof, welded to said flanges between said beams;

each of said end uprights comprising a beam of channel cross-section, the flanges of which extend away from the opposite end upright and are welded to another gusseting means.

2. An upright shelf unit as recited in claim 1 wherein each of said gusseting means comprises:

a gusset having a trapezoidal shape the top end of which is positioned about halfway up the upright, the width of said top end being approximately the width of the channel, and the bottom end of which is substantially wider than said channel; and a reinforcing member having substantially a rectangular shape, of a width about the width of the top end of said gusset, extending from the top end of said gusset to about the top end of said upright.

3. In a mobile storage system having a number of mobile storage units, each of said mobile storage units including a carriage mounted on wheels which ride on rails mounted on a building floor, an upright shelving unit mounted on the carriage and comprising:

a pair of end uprights rigidly mounted substantially parallel to each other, and spaced apart from each other;

at least one interior upright assembly mounted rigidly between said end uprights;

a plurality of shelves, each having hooks at each end for hooking to and engaging with slots formed in each adjacent pair of uprights;

said interior upright assembly including:

a pair of beams of channel cross-section, oriented vertically and with the flanges of said beams extending toward each other;

a gusset welded between said beams, having a trapezoidal shape, the top end of which is positioned about halfway up the upright assembly, the width of said top end being approximately the width of the beams, and the bottom end of which is substantially wider than said beams, and a reinforcing member welded between the beams, having a substantially rectangular shape, of a width about the width of the top end of said gusset, extending from the top end of said gusset to about the top end of said upright assembly.

4. A mobile storage system as recited in claim 3 wherein each of said end uprights comprises:

a single beam of channel cross-section oriented vertically and with the flanges of said beam extending away from the opposite end upright;

a gusset welded to the flanges of said end upright beam and having a trapezoidal shape, the top end of which is positioned about halfway up the beam, the width of said top end being approximately the width of the beam, and the bottom end of which is substantially wider than said beam; and a reinforcing member welded to the flanges of said end upright beam, having a substantially rectangular shape, of a width about the width of the top end of said gusset, extending from the top end of said gusset to about the top end of said end upright.

* * * * *